US005295549A

United States Patent [19]

Dolezal et al.

[11] Patent Number: 5,295,549

[45] Date of Patent: Mar. 22, 1994

[54] MECHANICAL LOCK TO PREVENT SEAL RING ROTATION

[75] Inventors: George E. Dolezal, Friendswood; Douglas J. Clinkscales, Spring; Anton F. Zahradnik, Sugarland; Turlach P. Boylan, Houston, all of Tex.

[73] Assignee: Baker Hughes Incorporated, Houston, Tex.

[21] Appl. No.: 990,485

[22] Filed: Dec. 14, 1992

[51] Int. Cl.[5] ..... E21B 10/22

[52] U.S. Cl. ..... 175/371; 277/92; 384/94

[58] Field of Search ..... 175/228, 371, 372; 277/92; 384/94

[56] References Cited

U.S. PATENT DOCUMENTS

| | | | |
|---|---|---|---|
| 3,193,028 | 7/1965 | Radzimovsky | 175/228 |
| 3,251,634 | 5/1966 | Dareing | 175/228 |
| 4,179,003 | 12/1979 | Cooper et al. | 175/371 |
| 4,466,622 | 8/1984 | Deane et al. | 175/371 |
| 4,516,641 | 5/1985 | Burr | 175/228 |
| 4,623,028 | 11/1986 | Murdoch et al. | 175/371 |
| 4,666,001 | 5/1987 | Burr | 175/371 |
| 4,753,303 | 6/1988 | Burr | 175/372 X |
| 4,903,786 | 2/1990 | Welsh | 175/371 |
| 5,080,183 | 1/1992 | Schumacher et al. | 175/228 X |

*Primary Examiner*—Ramon S. Britts
*Assistant Examiner*—Frank S. Tsay
*Attorney, Agent, or Firm*—Robert A. Felsman

[57] ABSTRACT

An earth boring bit of the type having at least one rotatable cutter on a bearing shaft, a hydrostatic pressure compensator to balance the pressure of the lubricant with the pressure of the drilling fluid in the borehole, a metal face seal assembly of the type that enables movement of the seal to compensate for dynamic pressure changes in the lubricant as the cone moves on the bearing shaft, and a protuberance extending from a metal ring of the seal assembly into an aperture in the body of the bit adjacent the shaft with both axial and radial clearances sufficient to enable compensating movements of the seal assembly.

8 Claims, 4 Drawing Sheets

MECHANICAL LOCK TO PREVENT SEAL RING ROTATION

BACKGROUND OF THE INVENTION

1. Field of the Invention:

This invention relates generally to earth-boring bits, lubricated with a system that includes a hydrostatic pressure compensator to balance the internal pressure of the lubricant inside the bit with the hydrostatic pressure of a liquid drilling fluid that surrounds the bit during drilling. In this combination the invention relates to a metal face seal assembly.

2. Description of the Prior Art:

The first successful cantilevered rolling cutter bit invented by Howard R. Hughes, Sr., U.S. Pat. No. 930,759, did not have an effective seal but nonetheless utilized a piston type pressure lubricator that urged a heavy grease into a friction or journal bearing. Because the grease was expended too rapidly, sealed bearing designs were eventually abandoned in favor of unsealed bits with anti-friction, ball and roller bearings that were unlubricated. Such bits were commercially successful in the '40s and in the '50s, lasting into the '60s when Gerald O. Atkinson et al perfected the first seal useful for relatively long periods in retaining lubricant in the anti-friction bearings, as disclosed in U.S. Pat. No. 3,075,781.

Because a friction or journal bearing has greater load carrying capacity than an anti-friction bearing, its potential was not forgotten and was unlocked in the late 1960's by Edward M. Galle, who provided an O-ring sealed journal bearing combination that sometimes lasted twice as long as anti-friction bearings in the hard, slow drilling of West Texas. (See U.S. Pat. No. 3,397,928.) This bit became predominant in the marketplace, but the O-ring seal has limitations that prevented it from being the final solution to the puzzle of sealing rock bit bearings.

U.S. Pat. No. 4,516,641 of Bruce H. Burr discloses the first commercially successful rock bit which utilizes a metal face seal. In this bit the seal assembly acts as a secondary compensator, being free to move axially in the seal groove to limit pressure buildup in the lubricant behind the seal caused by the rapid movement of the cutter on the bearing shaft.

The prior art recognizes an advantage in preventing the rotation of a Bellville and certain other seals by press fit, adhesives, staking or the use of an abutment. (See U.S. Pat. No. 3,680,873 and the prior art referred to therein.) One attempt to prevent rotation of a metal face seal relative to the bearing shaft is to roughen the seal groove by particulate blasting to increase the coefficient of friction between the metal and a resilient portion of the seal. If rotation occurs, the roughened surface may result in an accelerated deterioration of the resilient member and a consequent loss of sealing effectiveness.

SUMMARY OF THE INVENTION

The general object of the invention is to provide, in a drill bit having a hydrostatic pressure compensator, a rigid, preferably metal, face seal that moves axially to minimize the dynamic changes in the pressure of the lubricant near the seal when the cutter moves axially or wobbles during drilling. The movement of the seal assembly relative to the bearing shaft is prevented by a locking means that utilizes a protuberance extending from a rigid ring of the assembly into an aperture formed in the body. There is sufficient clearance between the protuberance and the aperture in the axial direction to permit movement of the seal assembly relative to the bearing shaft to permit pressure compensation. Also, there is sufficient clearance between the protuberance and the aperture in the radial or circumferential dimensions to assure the absence of friction that will prevent pressure compensating movements of the seal assembly. Other objects, features and advantages of the invention will become apparent in the following detailed description.

DESCRIPTION OF THE PREFERRED EMBODIMENT

Figure 1:
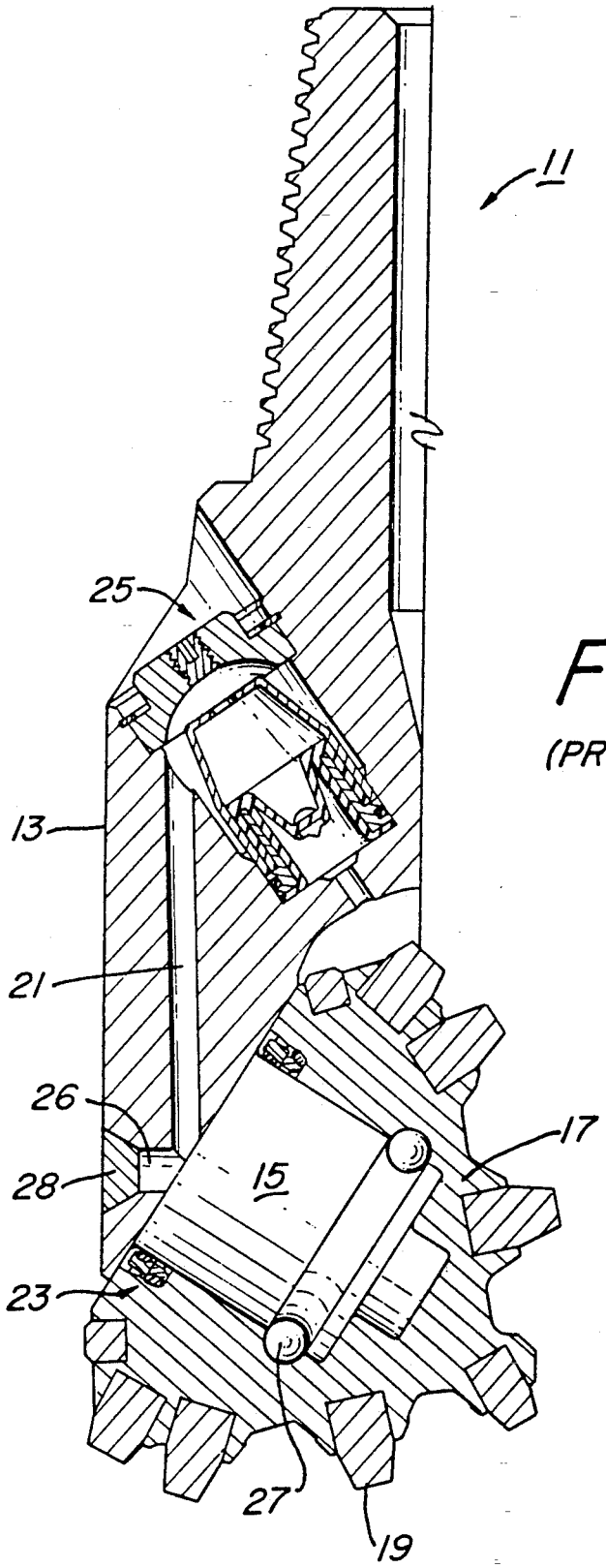
Fig. 1 (PRIOR ART)
FIG. 1 is a view in longitudinal section of a portion of an earth boring bit, showing a compensator system, bearing shaft, cutter and seal assembly of the prior art type shown in U.S. Pat. No. 4,516,641.

The numeral 11 in FIG. 1 of the drawings designates a lubricated, rotatable cone or cutter-type earth boring bit having a body formed in three head sections or legs 13, only one of which is shown. Each leg 13 includes an oblique cantilevered bearing shaft 15 that depends inwardly and downwardly to support a rotatable cutter 17 having earth disintegrating teeth 19. Lubricant passage 21 supplies lubricant to the bearing surfaces between the bearing shaft 15 and cutter 17. A seal assembly 23 retains lubricant in the bearing and prevents borehole fluid from entering the bearing. A hydrostatic pressure compensator 25 is part of a lubrication system connected with the lubricant passage 21 to equalize the pressure of the liquid lubricant inside the bearing with the hydrostatic pressure of the liquid in the borehole. This prior art bit is disclosed in greater detail in U.S. Pat. No. 4,516,641 and is believed to be the first, commercially successful embodiment of a metal face seal assembly in a "rock bit" in the petroleum industry. The basic components of this rock bit are typical, but the features vary by the use of different means to retain the cutter on the bearing shaft, different forms of hydrostatic pressure compensators, different types of bearings (roller or journal) and different forms of metal face seal assemblies, as seen for example in U.S. Pat. No. 4,923,020.

In the rock bit of FIG. 1, the geometry of the bearings on the shaft 15 within the cutter 17 are of a prior art configuration, including the use of a ball bearing retainer 27, which with a plug 26 welded at 28 retains the cutter rotatably on the bearing shaft.

Figure 2:
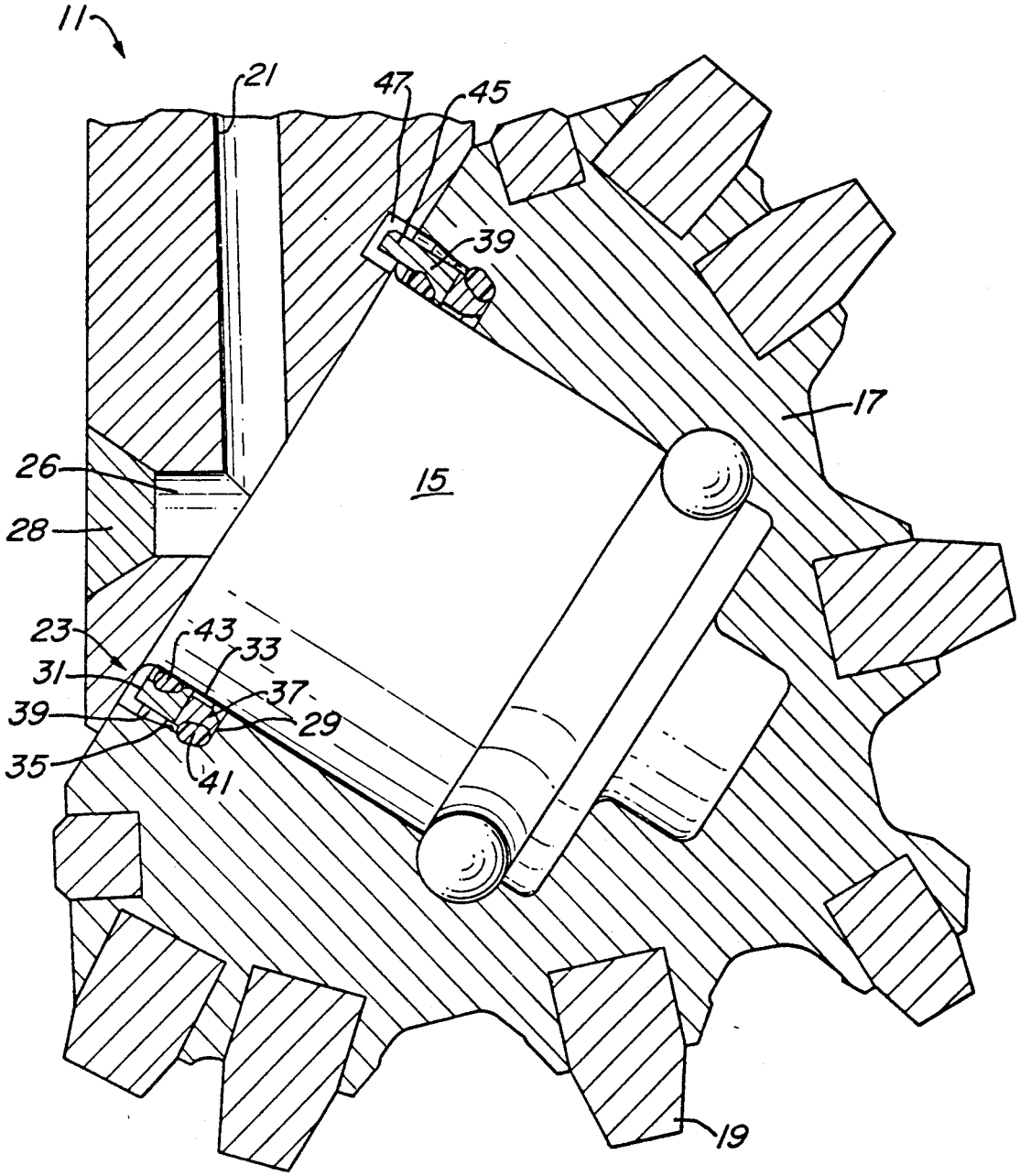
FIG. 2 is a side elevational view, partially in section, of a portion of the body, bearing shaft, cutter and seal assembly that utilizes the principles of the invention.

Referring especially to FIG. 2, the cutter 17 and shaft 15 contain the seal assembly 23 with an annular seal groove or gland that has axially spaced, generally radial end walls 29, 31 and inner and outer circumferential or cylindrical walls 33, 35. Circumferential wall 33 is an outer portion of the journal bearing surface of bearing shaft 15.

The seal assembly 23 includes a pair of annular rigid, in this case metal rings 37, 39 with opposed, radial sealing faces as generally shown in U.S. Pat. No. 4,516,641. The pair of rigid rings has a radially measured thickness less than the minimum annular space between the inner and outer circumferential walls 33, 35 of the groove, and an axially measured width which is less than the minimum width or the distance between the end walls 29, 31 of the groove.

Each of a pair of resilient energizer rings 41, 43 extends between a surface of an opposed and engaged metal ring and a circumferential wall 33, 35 of the seal to urge the metal rings together, retain lubricant within the bearing area and exclude drilling mud from the bearing area.

As explained in U.S. Pat. No. 4,516,641, there are clearances between each of the end walls 29, 31 of the groove and the engaged metal rings 37, 39 when the seal assembly and cutter 17 are assembled during the manufacturing process. As explained in said patent, the clearances permit movement of the rigid rings and of the roll/compression type energizers to permit compensation of the dynamic pressure variations that occur otherwise in the lubricant adjacent to the seal assembly.

It is advantageous that the resilient energizer ring 43, called the "shaft" resilient ring and the opposing shaft rigid or metal ring 39 be prevented from rotation on the shaft. It is also advantageous that the cutter resilient ring 41 and cutter ring 37 are stationary with respect to the cutter 17. Thus, the only relative movement occurs between the opposed faces of the metal rings 37, 39. In an effort to reduce a tendency of the shaft resilient ring 43 to rotate, the area of engagement of the ring 43 against circumferential wall 33 and radial wall 31 are blasted with aluminum oxide particles to a surface roughness of about 250 to 400 RA. The metal rings where they engage the resilient rings are roughened to about 150 RA. However, there are instances where this surface roughening has been insufficient to prevent rotation of the resilient ring on the shaft and apparently contributed to an abraiding or tearing of the resilient ring.

In FIG. 2 is shown an axially extending protuberance 45, integral with the shaft rigid ring 39 to lock the ring against rotation with the cutter to prevent rotation of the shaft resilient ring 43. As indicated in FIG. 2, there is an axial clearance between the end of the protuberance 45 and the bottom of the aperture 47. Also, there are inner and outer clearances between the upper and the lower surfaces of the protuberance and the aperture 47. The axial clearance should be a minimum of about 0.040 inch to permit unrestricted axial movement of the shaft rigid ring 39, and the radial clearance should be a minimum of about 0.040 inch to account for radial misalignment or movement between the shaft rigid ring 39 and the shaft 15. Since there are cuttings and other debris in the drilling fluid which surround the drill bit, the axial clearance should be greater than the above-stated minimum, preferably about 0.10 inch and the radial clearance should be greater than the stated minimum, preferably about 0.10 inch. Clearances in this range minimize the possibility that cuttings or other debris will become entrapped between the protuberance and aperature, which could result in the inability of the seal assembly to move in an unrestricted manner and serve as a secondary compensator to minimize dynamic pressure differentials across the seal and the resulting problems, such as a tendency of the resilient rings to extrude through the clearances. The edges of the protuberance 45 are rounded with a grinder.

Figure 3:
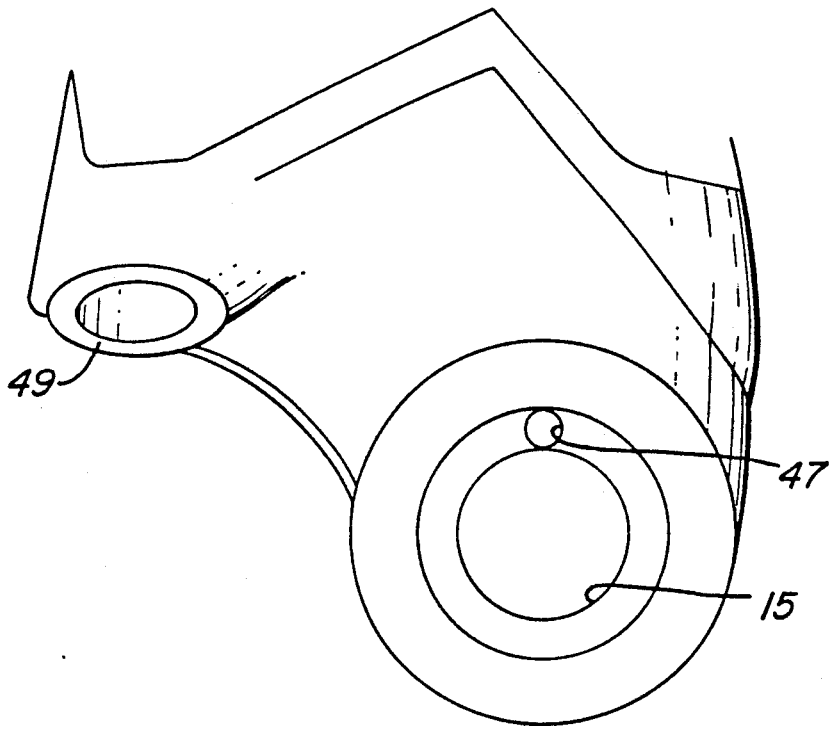
FIG. 3 is a fragmentary, perspective view as viewed looking axially down the end of the bearing shaft.

FIG. 3 is a view looking axially down the bearing shaft 15 to provide an end view of the aperture 47 which in this instance is circular. This view shows incidentally a nozzle boss 49 that contains a nozzle (not shown) through which drilling fluid is pumped to clean the bottom of the borehole and the cutters during drilling.

Figure 4:
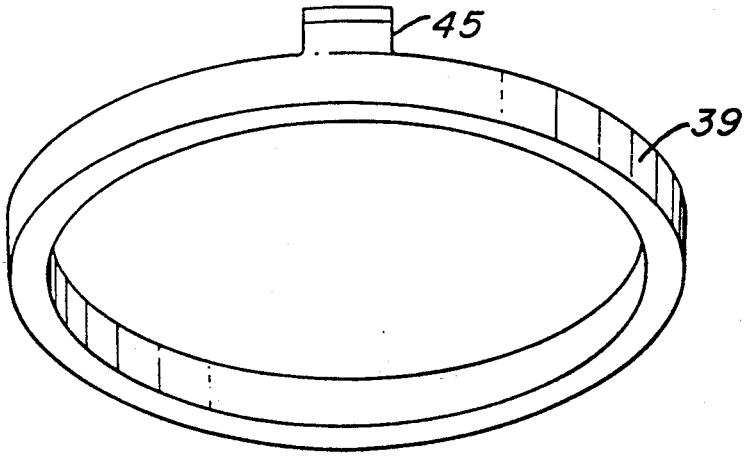
FIG. 4 is a perspective view of a rigid ring of the preferred seal assembly.
Figure 5:
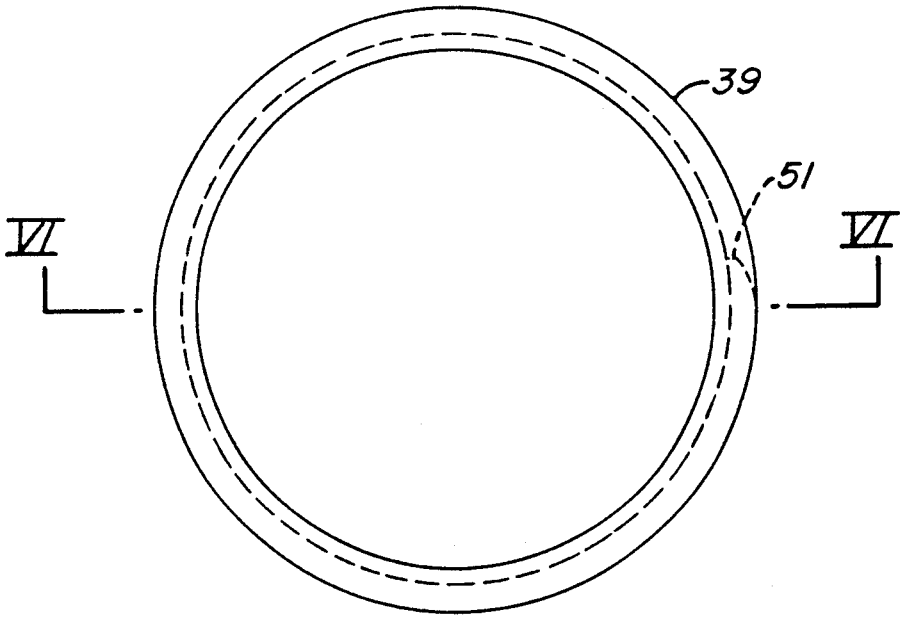
FIG. 5 is a plan view of the ring of FIG. 4.
Figure 6:
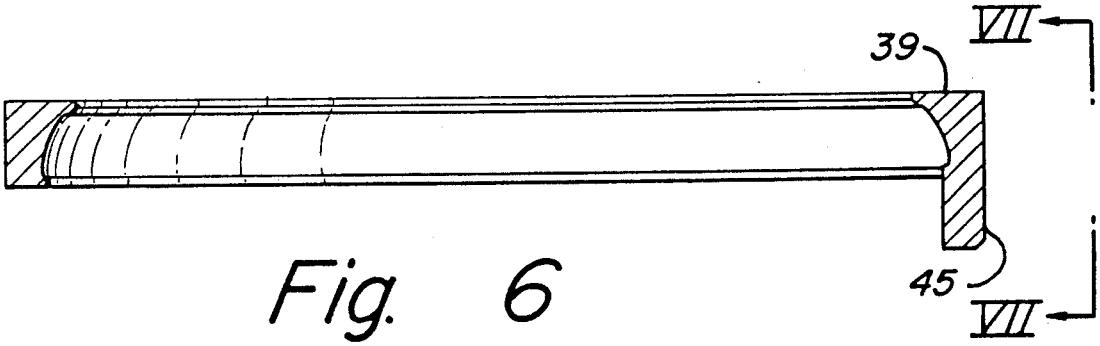
FIG. 6 is a cross-sectional view as seen looking along the line VI—VI of FIG. 5.
Figure 7:
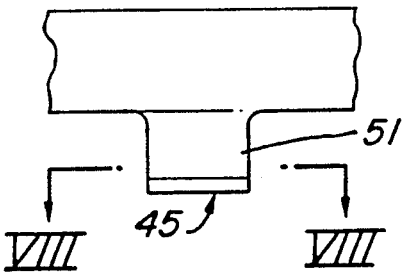
FIG. 7 is a fragmentary, end view seen looking along the lines VII—VII of FIG. 6.
Figure 8:
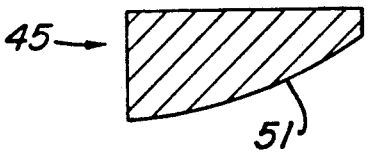
FIG. 8 is a cross-sectional view as seen looking along the lines VIII—VIII of FIG. 7.

Shaft rigid ring 39 is shown in perspective in FIG. 4 to illustrate the preferred shape of the protuberance 45. The shaft rigid ring 39 is shown also in FIG. 5, and in cross-section in FIG. 6, which shows that the protuberance 45 as being integral with the shaft rigid ring 39. FIG. 7 is a fragmentary portion of the ring and FIG. 8 is a cross-sectional view which show that the upper surface 51 of protuberance 45 is curved, a feature which is also shown in FIG. 5. This curved surface 51 streamlines the protuberance and is thought to be beneficial in deflecting cuttings or other particle from the drilling fluid and thus help prevent the collection of such material between the protuberance and the aperture.

It will be apparent to those of average skill in the art that the invention has significant advantages. The use of a pressure compensating seal assembly in an earth boring bit using a metal face seal is advantageous in enabling fast rotational speeds of the bit during drilling. Since only the metal faces experience relative movement, there is less likelihood of damage to the resilient portions of the seal, which are stationary and do not experience relative movement compared to either the cutter or the shaft. The use of the present invention to lock the shaft metal seal against rotation relative to the shaft also prevents relative movement between the shaft resilient seal and the shaft. This lessens the likelihood that cuttings or other detriment will cause premature wear of the shaft resilient seal or the surfaces which it engages. The rotation of the seal ring is resisted by the protuberance. The torsional loads from the seal rings are reacted by the protuberance and aperture, thus unloading the resilient ring from circumferential loading. Any reduction of stress in the resilient ring prolongs its life in a drilling environment.

While the invention has been shown in only one of its forms, it should be apparent to those skilled in the art that it is not thus limited, but is susceptible to various changes and modifications without departing from the spirit thereof.

We claim:

1. An earth boring bit adapted for removable attachment to a drill string member, with an improved pressure compensating face seal assembly, the bit comprising:

a body having a hydrostatic pressure compensator adapted for attachment to a drill string member;

a cantilevered bearing shaft forming a portion of and extending obliquely inwardly and downwardly of the body;

a cutter secured for rotation about the bearing shaft and including an annular seal groove;

a rigid ring positioned in the seal groove with a first sealing face;

a resilient ring partially compressed between the bearing shaft and the rigid ring;

a second sealing face sealingly secured to the cutter to oppose and engage the first sealing face of said rigid ring;

the rigid ring being adapted to move axially in the seal groove to permit pressure compensating movement when the cutter moves relative to the bearing shaft;

an aperture formed in the body;

a protuberance extending from the rigid ring into the aperture with clearance to prevent rotation of the rigid ring and resilient ring when the cutter rotates on the bearing shaft during drilling, while permitting axial, pressure compensating movement of the seal assembly.

2. The invention of claim 1 wherein the resilient ring is an O-ring.

3. An earth boring bit adapted for removable attachment to a drill string member, with an improved pressure compensating face seal assembly, the bit comprising:

a body having a hydrostatic pressure compensator adapted for attachment to a drill string member;

a cantilevered bearing shaft forming a portion of and extending obliquely inwardly and downwardly of the body from a generally cylindrical base that intersects a shaft radial wall of a seal groove;

a cutter secured for rotation about the bearing shaft and including an annular seal groove having a cutter radial wall, spaced from and opposing the shaft radial wall, and a cylindrical wall spaced from and opposing the bearing shaft that intersects the shaft radial wall;

a rigid ring positioned in the seal groove with a first sealing face;

a resilient ring partially compressed between the bearing shaft and the rigid ring;

a second sealing face sealingly carried by the cutter to oppose and sealingly engage the first sealing face of said rigid ring;

the axial width of the rigid ring being less than the axial, minimum width of the seal groove when the cutter is thrust outwardly on the bearing shaft to define at least one axial clearance to permit pressure compensating movement of the rigid ring between the shaft and cutter radial walls when the cutter moves relative to the bearing shaft;

an aperture formed in the body;

a protuberance extending from the rigid ring into the aperture with a selected clearance to prevent rotation of the rigid ring and resilient ring when the cutter rotates on the bearing shaft during drilling, while permitting axial, pressure compensating movement of the seal assembly.

4. The invention defined by claim 3 wherein said protuberance extends axially from an outward portion of the rigid ring, and said aperture is formed in the shaft radial wall, with both axial and radial clearances.

5. The invention defined by claim 4 wherein the resilient ring is an O-ring.

6. An earth boring bit adapted for removable attachment to a drill string member, with an improved pressure compensating face seal assembly, the bit comprising:

a body having a pressure compensator adapted for attachment to a drill string member;

a cantilevered bearing shaft forming a portion of and extending obliquely inwardly and downwardly of the body from a generally cylindrical base that intersects a shaft radial wall of a seal groove;

a cutter secured for rotation about the bearing shaft and including an annular seal groove having a cutter radial wall, spaced from and opposing the shaft radial wall, and a cylindrical wall spaced from and opposing the bearing shaft that intersects the shaft radial wall;

a first rigid ring positioned in the seal groove with a first sealing face;

a first resilient ring of the roll/compression type partially compressed between the bearing shaft and the rigid ring;

a second rigid ring with a second sealing face carried by the cutter to oppose and sealingly engage the first sealing face of said rigid ring;

a second resilient ring of the roll/compression type partially compressed between the annular seal groove and the second rigid ring;

the axial width of the rigid rings being less than the axial, minimum width of the seal groove when the cutter is thrust outwardly on the bearing shaft to define at least one axial clearance to permit pressure compensating movement of the rigid rings between the shaft and cutter radial walls when the cutter moves relative to the bearing shaft;

an aperture formed in the body;

a protuberance extending from the rigid ring into the aperture with a selected clearance to prevent rotation of the rigid ring and resilient ring when the cutter rotates on the bearing shaft during drilling, while permitting axial, pressure compensating movement of the seal assembly.

7. The invention defined by claim 6 wherein said protuberance extends axially from an outward portion of the first rigid ring, and said aperture is formed in the shaft radial wall, with both axial and radial clearances.

8. The invention defined by claim 7 wherein the resilient ring is an O-ring.

* * * * *